US005155952A

United States Patent [19]

Herwegh et al.

[11] Patent Number: 5,155,952

[45] Date of Patent: Oct. 20, 1992

[54] GLAZING PROFILE STRIP FOR SOLID GLAZING OR FILLER ELEMENTS ON THE OUTER FACES OF BUILDINGS

[75] Inventors: Norbert Herwegh, Schattdorf, Switzerland; Wolfgang Kemmer, Würzburg, Fed. Rep. of Germany

[73] Assignee: Mero-Raumstruktur GmbH & Co., Wurzburg, Fed. Rep. of Germany

[21] Appl. No.: 392,982

[22] PCT Filed: Sep. 8, 1988

[86] PCT No.: PCT/CH88/00155

§ 371 Date: Jul. 19, 1989

§ 102(e) Date: Jul. 19, 1989

[87] PCT Pub. No.: WO89/04408

PCT Pub. Date: May 18, 1989

[30] Foreign Application Priority Data

Nov. 12, 1987 [CH] Switzerland ..... 4420/87

[51] Int. Cl.[5] ..... E04B 1/684

[52] U.S. Cl. ..... 52/100; 52/98; 52/312; 52/461; 52/468; 52/395; 52/716; 52/717.1

[58] Field of Search ..... 52/393, 395, 461, 465, 52/468, 469, 470, 716, 717.1, 586, 312, 98, 100

[56] References Cited

U.S. PATENT DOCUMENTS

| | | | |
|---|---|---|---|
| 3,339,329 | 9/1967 | Berg | 52/461 |
| 3,841,045 | 10/1974 | Criswell | 52/395 |
| 4,067,155 | 1/1978 | Ruff et al. | 52/395 |
| 4,222,210 | 9/1980 | Hanstein et al. | 52/772 |
| 4,385,850 | 5/1983 | Bobath | 52/461 |

FOREIGN PATENT DOCUMENTS

| | | | |
|---|---|---|---|
| 1452891 | 4/1966 | France | 52/393 |

*Primary Examiner*—David A. Scherbel
*Assistant Examiner*—Robert Canfield
*Attorney, Agent, or Firm*—Herbert Dubno; Yuri Kateshov

[57] ABSTRACT

A glazing profile strip (1) which has a foot (9) with a toothing (10) for anchoring the strip (1) on a spacer (2) connected to the structure (4) of the building, has a slot (11) in that foot (9). This slot initiates at the outside (12) of the two sealing lips (6) protruding from the foot (9) and first forms a though-like enlargement (13). This enlargement serves for receiving a filler profile strip (17) that is connected to the sealing lips (6) only by thin bridges (18). The slot then continues below that enlargement by forming a narrow portion (14) having a flared mouth (141) and terminates in a larger groove (15). The narrow portion (14) is formed by two ribs opposed to each other which have a lower side (25) formed as an undercut. That side (25) serves as a rest for a head of a replacement filler profile strip which is inserted into the slot. Prior to this insertion, the present filler profile strip (17) is removed by separating its thin bridges (18) from the walls of the enlargement. The lower side (25) of the narrow portion secures the head of the replacement profile strip and with it the strip itself against being pulled out of the slot.

Thanks to the possibility of replacing the filler profile strip (17) by another one of different design, different dimensions and different aspect the glazing profile strip can be used for different requirements without altering its basic concept.

9 Claims, 1 Drawing Sheet

GLAZING PROFILE STRIP FOR SOLID GLAZING OR FILLER ELEMENTS ON THE OUTER FACES OF BUILDINGS

CROSS REFERENCE TO RELATED APPLICATIONS

This application is a national phase application of PCT/CH88/00155 filed Sep. 8, 1988 and based upon a Swiss national application 144020/87 of Nov. 12, 1987 under the International Convention.

FIELD OF THE INVENTION

The present invention relates to a glazing profile strip for the simultaneous holding and sealing of solid glazing of filler elements on planar or vaulted outer faces of buildings, said profile strip being securable against a spacer attached to the supporting elements of the building for the purpose of sealing these glazings or filler elements at their outer side and having a section of substantially mushroom-shaped cross section with an anchoring foot and two sealing lips radiating therefrom. This sealing profile strip is therefore intended for roofs of all grades of incline and shapes, i.e. from a nearly level roof up to the steepest one and from the barreled vault to the cupola, as well as for vertical facades of straight or curved form.

BACKGROUND OF THE INVENTION

Earlier glazing profile strips are described in Swiss Patent No. 671,998 (Application No. 1699/86) and European Patent publication 0 244 349 (Application no. 87810134.4). Said device of these patent documents substantially consists of three parts, namely a base profile strip which is placed directly onto the support structure of the building, a spacer also connected to it and a glazing stip having a substantially mushroom-shaped cross section and secured to the spacer. The present invention relates to the glazing profile strip only.

To this effect it is necessary to explain that the glazing strip holds, with each one of its sealing lips, a respective glass panel or a filler element along the margin on the outer side of the latter whereas the inner side rests on the base profile strip already mentioned. The glazing strip engages into an internal toothing of the spacer by means of an external toothing on its anchoring foot. This strip as well as the base profile strip are of such a shape that adjacent glass panels or filler elements as a rule lie in one plane. However, since both strips consist of elastomeric material, they are sufficiently resilient so as to permit angular positions between said panels or elements. Depending upon the extent of this angularity, the sealing lips of the glazing strip will become more or less deformed. If the angularity is great, it may happen that the deformation of the sealing lips will be so slight that their contact pressure is reduced. It is one of the objects of the invention to avoid this deficiency.

Not only the great angularity may bring about problems. Also at a small angle low pressures may occur on the outside of the building during wind gusts or storms. These low pressures can exert such a strong suction onto the panels or elements that there exists the danger of these elements being pulled away perpendicularly from the wall of the building. Above all this effect stresses the sealing lips of the glazing profile strip. Although they are bent upwards and therefore more strongly deformed, increasing their resistance, the forces deriving from the suction are transferred to the toothing already mentioned, requiring the latter to be strong enough in order to avoid that the glazing profile strip will be pulled out of the spacer. To this effect it should be favorable on buildings exposed to strong winds if the connection between the glazing profile strip and the spacer could be reinforced.

A further reason, although of somewhat lesser importance, for improving the glazing profile strip is to render the outside of this strip, i.e. the visible side, more diversified by applying different colors to it, this in view of the fact that this outside is of considerable width and therefore presents an outstanding appearance. This aspect, too, can be realized by the present invention, as will be explained later in detail.

SUMMARY OF THE INVENTION

Accordingly, the invention provides a glazing profile strip of the kind referred to above, comprising a slot of variable width which begins at the convex upper side of the glazing profile strip, between the two sealing lips, having there its greatest width for creating a trough-shaped enlargement, and which continues at a reduced width into the anchoring foot, the strip further comprising a filler profile strip inserted into said trough-like enlargement, said filler profile strip being connected to at least one of the walls delimiting the enlargement only by means of at least one thin bridge, facilitating its removal from said enlargement.

As a rule, the filler profile strip consists of the same material as the entire glazing profile strip. This enables both strips to be produced in one step. Since the filler profile strip is connected to the glazing strip only by at least one thin bridge, it can easily be removed and replaced by another strip having other dimensions, another color, another material or a combination of all three features.

BRIEF DESCRIPTION OF THE DRAWING

The invention will now be explained further in detail by referring to the accompanying drawing showing various embodiments, in which.

SPECIFIC DESCRIPTION

Figure 1:
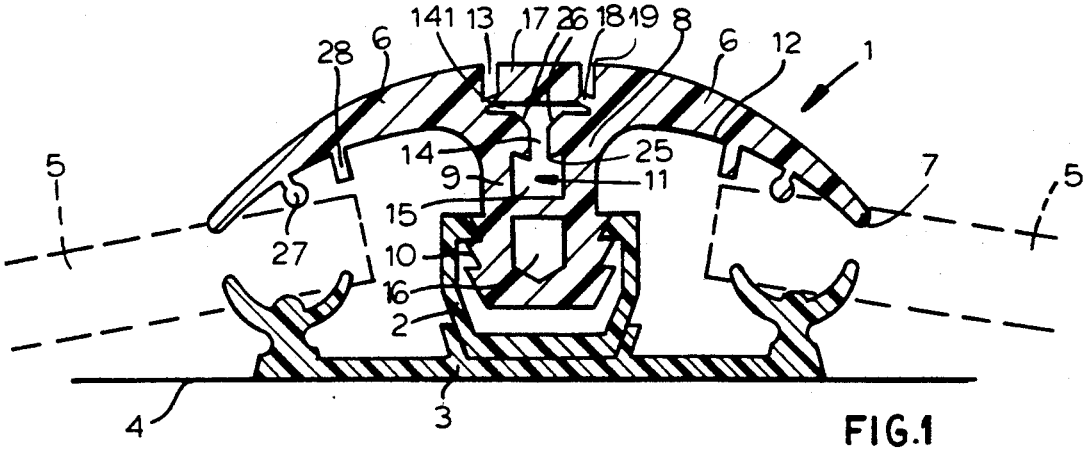
FIG. 1 is a section through a first embodiment of the glazing profile strip, together with the base profile strip and the spacer forming the glazing profile assembly of the invention.

In FIG. 1 the glazing profile strip 1 is represented in its first embodiment. In order to explain its function, spacer 2 holding the glazing profile strip by means of a toothing and base profile strip 3 are also illustrated, too. All these parts are supported by the structure 4 of the building, represented here only by a line, and secured to it e.g. by means of bolts. Glazing profile strip 1 and base profile strip 3 hold between them respective glass panels 5 or corresponding filler element along its margin. This panel or element is shown in dashed lines only because parts 1 to 3 are illustrated in their stress-free state. Both panels 5 or fillers may form an angle between them, but they may lie as well in one plane. Glazing profile strip 1 holds panel 5 at its outer side. Only that strip forms the subject matter of the present invention. Glazing profile strip 1 has two sealing lips 6, extending to each side and terminating with a curved shape in a tip 7 which presses onto the respective panel 5. The two sealing lips 6 join at their roots 8, forming a foot 9 which has a toothing 10. With the latter the glazing profile strip is secured in spacer 2 as shown.

What is new is a slot 11 in foot 9. In this embodiment it extends from the vaulted or convex outer side 12 of the sealing lips 6 to about the level of toothing 10. As can be seen, its width varies considerably. It is greatest at its top, i.e. directly at outer side 12 so that a trough-like enlargement 13 is formed there. Afterwards slot 11 changes into a narrow portion 14 which initially has a flared mouth 141 and, adjacent to the latter, is formed by parallel walls 142 at the end of which slot 11 widens again. Groove 15 formed by this widening of slot 11, however, is of minor width compared with enlargement 13. Below groove 15 there is a cavity 16 which, however, serves only for saving material; in addition it makes foot 9 somewhat more compressible which facilitates the insertion of glazing profile strip 1 into spacer 2.

Within enlargement 13 there is a filler profile strip 17. By means of thin bridges 18 attached to its lower longitudinal side it is connected to the vertical walls 19 of enlargement 13. As a rule it is manufactured simultaneously with the glazing profile strip and therefore consists of the same material as the latter. The same holds true also for bridges 18. Filler profile strip 17 fills out enlargement 13 nearly completely and also substantially has the same cross section.

Normally glazing profile strip 1 is mounted as illustrated in FIG. 1, i.e. together with filler profile strip 17. It therefore acts as a solid body, and thus the two sealing lips 6 come to rest against filler profile strip 17 when strip 1 is inserted into toothing 10 of spacer 2. This prevents the sealing lips from approaching each other too closely and with it, from pressing glazing profile strip 1 too deeply into toothing 10. For this reason vertical walls 19 of trough-like enlargement 13 are practically perpendicular to convex outer side 12 or, in other words, they are perpendicular to a horizontal tangent to that outer side 12. Since, as already mentioned, filler profile strip 14 substantially has the same cross section as enlargement 13, the pressures arising from the compression due to the deflection of sealing lips 6 are transferred from walls 19 onto filler profile strip 17 and are taken up by the latter. If walls 19 would diverge upwardly from each other, filler profile strip 17 might be separated from bridges 18 by this pressure and squeezed out of enlargement 13.

As mentioned, filler profile strip 17 usually consists of the same material as the entire glazing profile strip and therefore is of the same color when manufactered. It may be desirable to break up the monotony of the relatively large outer side by using other colors or by using a different surface. To this effect filler profile strip 17 is removed which poses no problems thanks to the thin bridges 18. Another strip can now be inserted which replaces original strip 17 and fills out enlargement 13 but is differently colored, consists of another material or has a different surface structure. In most cases all three features are united in the new filler profile strip.

This, however, is not the only possibility that presents itself when original filler profile strip 17 is replaced. FIG. 1 illustrates the two panels 5 being at an angle to each other. If that angle should be diminished, i.e. if the angularity is to be increased, the compressive force of tips 7 of sealing lips 6 may perhaps become insufficient. In this case a new filler profile strip is used which is larger than the removed one. Enlargement 13 thus becomes widened so that tips 7 in the not yet mounted state move downwards. In the mounted state this leads to an increase of the pressure acting on panels 5 and therefore the same compressive force is reached again as on panels 5 of smaller angularity.

On the other hand the original filler profile strip 17 may be too large if the two panels in FIG. 1 would diverge upwards. The mounting of glazing profile strip 1 would then become extremely difficult. If strip 17 is replaced by a smaller one, tips 7 of the sealing lips can move upwards, and the mounting of glazing profile strip 1 is again possible without any problem.

It is however, important in each case that the new filler profile strip, the so-called replacement filler, be well anchored in the glazing profile strip as otherwise it might be squeezed out again by pressure variations. It is to be remembered that it has no connection to walls 19 of enlargement 13 after having been inserted as was the case where bridges 18 of original filler 17 connected the filler 17 to the walls 19. In order to keep replacement filler in place and to mount it in an easy manner, which may be effected prior or after the insertion of glazing profile strip 1, the replacement filler as well as slot 11 below enlargement 13 must have a particular shape which now will be explained with reference to FIG. 2.

Figure 2:
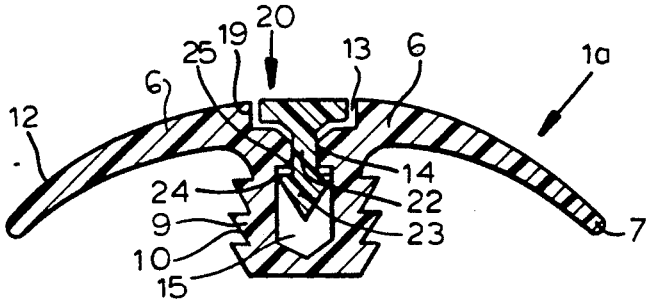
FIG. 2 is a section through a second embodiment of lesser hight of the glazing profile strip alone in which the filler profile strip has been replaced by another one.

In FIG. 2 such a replacement filler, bearing reference numeral 20, is already inserted. It comprises a head 21 the section of which substantially corresponds to the one of replaced filler profile strip 17 and also closely has the same dimensions except if it ought to be larger or smaller due to the reasons just outlined. To this head 21 a bridge 22 is connected that comes to lie in the narrow portion 14. The lower end of bridge 22 carries an anchoring foot 23 which is considerably larger than bridge 22 and comes to rest in groove 15. Narrow portion 14 substantially is formed by two ribs opposed to each other and protruding downwards into groove 15. These ribs may deform themselves when foot 23 is pressed through narrow slot 14 during insertion of the replacement filler. This insertion under pressure is facilitated by flared mouth 141. When foot 23 has passed narrow portion 14, the ribs will resume their original position. Upper face 24 of foot 23 comes to rest, due to upwardly directed tensile forces acting on replacement filler 20, against lower faces 25 of the ribs, said faces forming an undercut. In this way filler 20 is well anchored. This anchorage is capable of taking up very high tensile forces which can be transmitted perfectly to the structure 4 of the building (FIG. 1).

It should be mentioned that enlargement 13 has a bottom 26 that runs parallel to the tangent referred to above. This bottom therefore takes up the compressive forces that arise during insertion of replacement filler 20 and in this way prevents filler 20 from becoming pressed into slot 11 more deeply than necessary.

The embodiment of the glazing profile strip illustrated in FIG. 2 is of somewhat reduced height, compared with that of FIG. 1. In the following it will be designated 1*a*. It serves in particular for being mounted in a horizontal direction on inclined roofs or facades, i.e. transversely to the line of fall because rainwater can flow easily over it due to its flat shape. Slot 11, however, is identical with that of glazing profile strip 1. Only cavity 16 below groove 15 is lacking. Also sealing lips 6 are made thinner.

Figure 3:
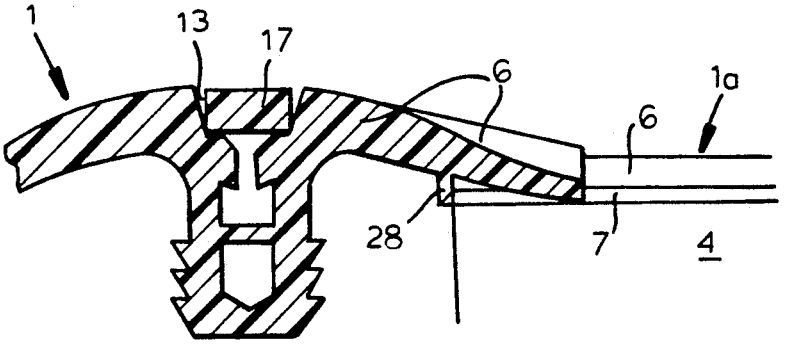
FIG. 3 is a sectional view of an intersection of a glazing profile strip according to FIG. 1 with one according to FIG. 2.

Glazing profile strip 1, on the other hand, is mounted in the direction of fall. At junctions with profile 1*a* it goes right through whereas strips 1*a* end on either side of it. This arrangement is schematically illustrated in FIG. 3, showing a view in the direction of fall. One recognizes profile strip 1*a* in a side view, i.e. in the direction of the arrow in FIG. 2 so that tip 7 of one sealing lip is visible in a front view. The sealing lip of glazing profile strip 1 located in the line of fall, represented without spacer 2 and base profile strip 3, partially overlies with its tip the glazing profile strip 1*a*. Since the latter, according to FIG. 2, has a convex outer side, too, sealing lip 6 its tip runs in an arch and therefore presents a hump when seen from above. Above and below glazing profile strip 1*a* crossed by sealing lip 6, the latter rests on structure 4 of the building. For a good sealing effect glazing profile strip 1 is equipped, on each of its sealing lips 6, with a rib, the so-called string 27. This string, visible in FIGS. 1 and 4, has above all the function, besides the sealing, of transmitting compressive forces, deriving from wind gusts and transferred from panels 5 onto glazing profile strip 1, (two occurrences) foot 9 and thus into strecture 4 on a shorter path compared with the one the forces acting on tips 7 have to take to reach structure 4; the tips therefore will be slightly relieved from these compressive forces but will still prevent the penetration of water. In the area of the overlapping of glazings profile file strip 1*a*, however, this string 27 is removed (FIG. 3); the removed section of the string corresponds in its length exactly to the width of glazing profile strip 1*a*.

Nevertheless the danger of leakages remains on the ends of this overlapping, i.e. at each location where profile strip 1 comes to rest directly upon structure 4 there exists a possibility of water seeping into the interior. For this reason a sealing compound is applied there. So that this compound does not flow into the cavity in the intersection of the two strips 1, 1*a*, preventing its ventilation, a rectangular rib 28 is attached to profile strip 1, extending in a direction practically perpendicular to the corresponding sealing lip 6. Rib 28 is arranged at such a distance from tip 7 of sealing lip 6 or from foot 9 that it rests on structure 4 as can be seen from FIG. 4 and in this manner does not only prevent the passage of sealing compound but serves at the same time also as a centering means for the mounting of the glazing profile strip 1.

Figure 4:
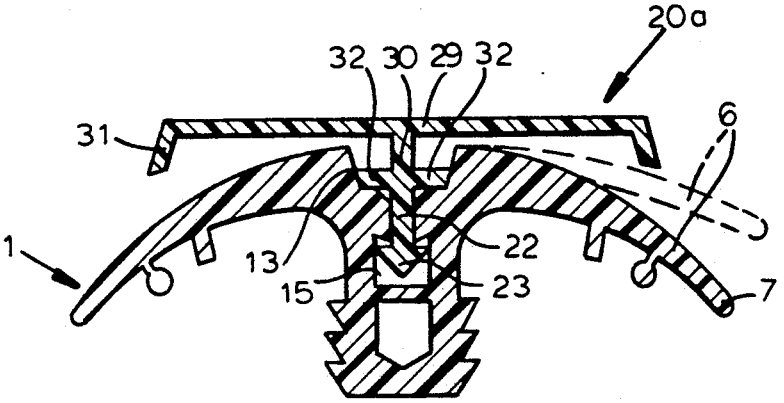
FIG. 4 is a section through a replacement filler profile strip made up as an additional reinforcement and glazing device.

Replacement filler 20 need not necessarily consist of the same material as original filler profile strip 17. It may even have a different shape as already mentioned. The only condition is that it can be inserted into slot 11 and can be well anchored therein. FIG. 4 discloses a replacement filler 20*a* which besides having a construction allowing it to function is also made up in such a manner as to support both sealing lips 6 at their outer sides 12. To this effect it consists of metal, as a rule of extruded aluminum. FIG. 4 shows it inserted into profile strip 1 in the not yet mounted state of the latter. Bridge 22 and foot 23 are the same as in FIG. 1. What is new is a U-shaped cover 29 at an extension 30 of bridge 22. This extension 30 has ends 31 at an angle thereto. The sealing lips 6 in their mounted and thus upwardly deflected state apply against these ends 31. Due to this cover 29 enlargement 13 in the glazing profile strip needs not to be filled completely; two angular pieces 32 acting as a centering means will do for this purpose. This kind of replacement fillers is to be recommended particularly on sites where strong winds and therefore high suction forces act on glazing profile strip 1.

Besides these illustrated embodiment of replacement filler 20, 20*a*, various other ones are conceivable. Preferably care should be taken when designing a glazing profile strip that these embodiments are interchangeable at will and that they fit into glazing profile strip 1 as well as into profile strip 1*a*. Wherever possible enlargement 13 and narrow portion therefore have always the same dimensions whereas groove 15 must only have the same width on all strips.

We claim:

1. A glazing profile strip for simultaneous holding and sealing of solid glazing or filler elements on planar or vaulted outer faces of buildings, securable against a spacer attached to the structure of the building for sealing said glazing or filler elements on their outer sides, said glazing profile strip having a substantially mushroom-shaped cross section with an anchoring foot and two sealing lips radiating therefrom, the glazing profile strip comprising a slot of variable width which beginning at a convex upper side of the glazing profile strip between the two sealing lips and, having at its beginning its greatest width for creating a trough-shaped enlargement having opposite longitudinally extending walls, said slot continuing at a reduced width into the anchoring foot, the glazing profile strip further comprising a filler profile strip inserted in said trough-shaped enlargement, said filler profile strip being connected to at least one of the walls delimiting said enlargement at most by a thin bridge uniting with the glazing profile strip and with said filler profile strip facilitating removal of the filler profile strip from said enlargement.

2. The glazing profile strip defined in claim 1 wherein the filler profile strip consists of the same material as the glazing profile strip.

3. A glazing profile strip for simultaneous holding and sealing of solid glazing or filler elements on planar or vaulted outer faces of buildings, securable against a spacer attached to the structure of the building for sealing said glazing or filler elements on their outer sides, said glazing profile strip having a substantially mushroom-shaped cross section with an anchoring foot and two sealing lips radiating therefrom, the glazing profile strip comprising a slot of variable width which beginning at a convex upper side of the glazing profile strip between the two sealing lips and, having at its beginning its greatest width for creating a trough-shaped enlargement, said slot continuing at a reduced width into the anchoring foot, the glazing profile strip further comprising a filler profile strip inserted in said trough-shaped enlargement, said filler profile strip being connected to at least one of the walls delimiting said enlargement at most by a thin bridge uniting with the glazing profile strip and with said filler profile strip facilitating removal of the filler profile strip from said enlargement, the walls delimiting said enlargement on opposite sides of the enlargement being parallel to each other and substantially perpendicular to a tangent to an outside of the glazing profile strip, said outside being curved corresponding to the mushroom shape, the bottom of said enlargement running substantially parallel to said tangent.

4. A glazing profile strip as defined in claim 1, wherein the slot extends below the enlargement in a narrow portion having a flared mouth and formed between elastically deformable ribs which have a lower side in the form of an undercut, said ribs delimiting a groove subsequent to said narrow portion and serving as a rest for a foot of a replacement profile strip introduced into the slot after removal of the filler profile strip.

5. A glazing profile strip for simultaneous holding and sealing of solid glazing or filler elements on planar or vaulted outer faces of buildings, securable against a spacer attached to the structure of the building for sealing said glazing or filler elements on their outer sides, said glazing profile strip having a substantially mushroom-shaped cross section with an anchoring foot and two sealing lips radiating therefrom, the glazing profile strip comprising a slot of variable width which beginning at a convex upper side of the glazing profile strip between the two sealing lips and, having at its beginning its greatest width for creating a trough-shaped enlargement, said slot continuing at a reduced width into the anchoring foot, the glazing profile strip further comprising a filler profile strip inserted in said trough-shaped enlargement, said filler profile strip being connected to at least one of the walls delimiting said enlargement at most by a thin bridge uniting with the glazing profile strip and with said filler profile strip facilitating removal of the filler profile strip from said enlargement, the slot extending below the enlargement in a narrow portion having a flared mouth and formed between elastically deformable ribs which have a lower side in the form of an undercut, said ribs delimiting a groove subsequent to said narrow portion and serving as a rest for a foot of a replacement profile strip introduced into the slot after removal of the filler profile strip, further comprising a long foot with a toothing, said toothing being arranged below the groove delimited by said ribs and formed with a cavity underneath said section.

6. The glazing profile strip defined in claim 5 wherein the sealing lips have on their lower sides respective string-like longitudinal ribs as well as a sealing rib disposed between the respective longitudinal rib and the long foot and protruding perpendicularly from the respective sealing lip.

7. The glazing profile strip defined in claim 4, further comprising a short foot with a toothing that is arranged on both sides of the groove forming the lowermost section of the slot.

8. The glazing profile strip defined in claim 5 wherein the long foot has an enlargement and a narrow portion for receiving replacement profile strips of different designs.

9. The glazing profile strip defined in claim 7 wherein the slot in the short foot has an enlargement and a narrow portion for receiving replacement profile strips of different designs.

* * * * *